United States Patent [19]

Hanson et al.

[11] 4,230,030

[45] Oct. 28, 1980

[54] MACHINE AND METHOD FOR MANUFACTURING SQUARE OR FLAT BOTTOM BAGS HAVING MOVABLE POSITIONS OR STATIONS INCLUDING THE USE OF A MANDREL

[75] Inventors: Violet M. Hanson, P.O. Box 163, Plainview, N.Y. 11804; Edgar Strecker, Freeport, N.Y.

[73] Assignee: Violet M. Hanson, Old Bethpage, N.Y.

[21] Appl. No.: 933,085

[22] Filed: Aug. 11, 1978 (Under 37 CFR 1.47)

[51] Int. Cl.[2] ..... B31B 33/14

[52] U.S. Cl. ..... 93/35 SB; 93/33 H; 93/12 R; 53/567

[58] Field of Search ..... 93/33 H, 10, 11, 12 R, 93/84 TW, 22-24, 28-30, 35 R, 35 SB, 14-17; 53/551, 552, 567, 241, 256, 459

[56] References Cited

U.S. PATENT DOCUMENTS

| | | | |
|---|---|---|---|
| 3,094,905 | 7/1960 | Haslacher | 93/35 SB |
| 3,250,187 | 6/1963 | Kasting | 93/8 R |
| 3,345,919 | 2/1965 | Kasting et al. | 93/8 R |
| 3,552,081 | 1/1971 | Leasure | 53/552 |
| 3,916,769 | 11/1975 | Turunen | 53/567 |
| 3,924,521 | 12/1975 | Hanson et al. | 93/33 H |
| 3,970,241 | 7/1976 | Hanson | 229/58 |
| 3,988,970 | 11/1976 | Hanson et al. | 93/14 |

FOREIGN PATENT DOCUMENTS

| | | | |
|---|---|---|---|
| 486964 | 1/1976 | U.S.S.R. | 53/567 |

*Primary Examiner*—Robert Louis Spruill
*Assistant Examiner*—K. Y. Lin
*Attorney, Agent, or Firm*—Bauer & Amer

[57] ABSTRACT

A method and apparatus for the rapid and continuous formation of reinforced flat bottom bags from a substantially endless roll of gussetted tubing.

44 Claims, 10 Drawing Figures

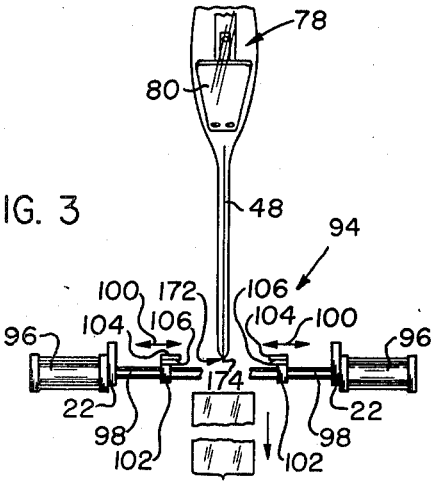
FIG. 3
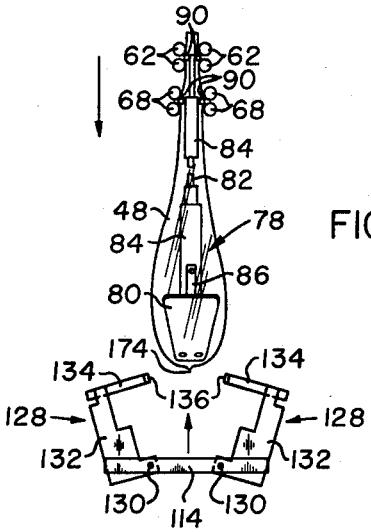
FIG. 4
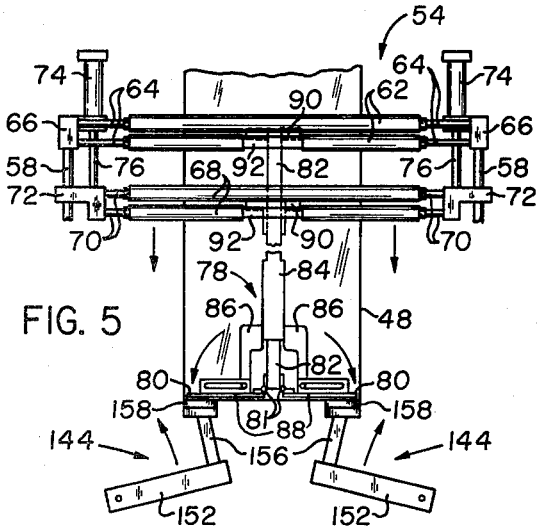
FIG. 5
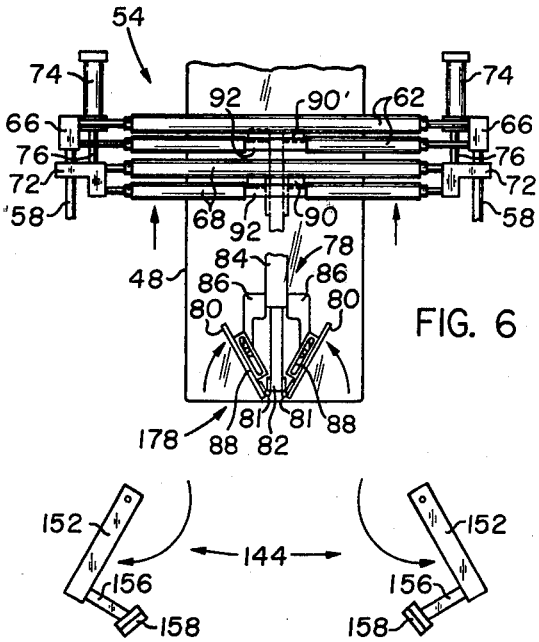
FIG. 6
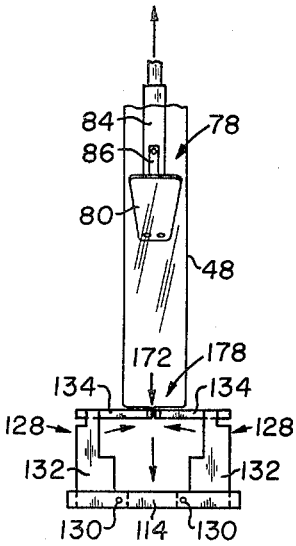
FIG. 7
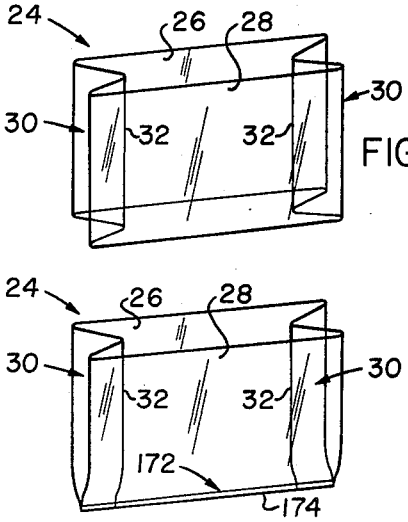
FIG. 8
FIG. 9
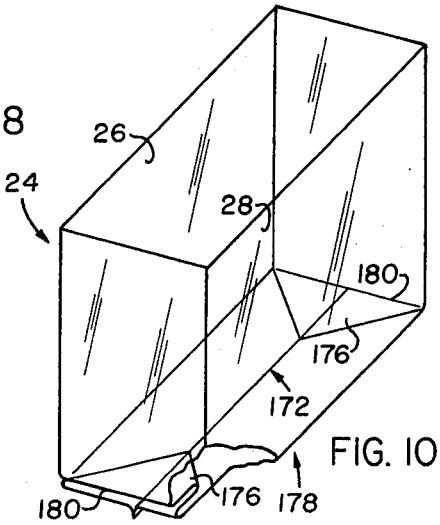
FIG. 10

MACHINE AND METHOD FOR MANUFACTURING SQUARE OR FLAT BOTTOM BAGS HAVING MOVABLE POSITIONS OR STATIONS INCLUDING THE USE OF A MANDREL

BACKGROUND OF THE INVENTION

The present invention relates to a method and apparatus for forming flat bottom bags.

In U.S. Pat. No. 3,970,241, there is disclosed a construction for a reinforced flat bottom bag having a bottom of more than one thickness. The present invention has as its main object provision of an improved method and apparatus for forming the bag disclosed in the aforementioned U.S. patent and simple apparatus for carrying out the improved method in a rapid and continuous cyclical operation.

The known prior art devices for forming flat bottom bags from relatively thin-walled plastic material are complex and extremely costly both to manufacture and to operate. In addition, they are generally incapable of producing the bags in a limited amount of space and with a degree of rapidity sufficient to render the operation economically attractive. Thus, the end costs of the flat bottom bags produced thereby are relatively high resulting in diminished sales as bag users substitute less expensive but less satisfactory bag constructions than the relatively costly flat bottom bags.

It is a particular object of the present invention to provide a method and apparatus for the production of thin-walled flat bottom bags formed of a thermoplastic material.

It is a further object of the present invention to provide a method and apparatus for forming flat bottom bags utilizing a substantially endless supply of thermoplastic material in tubular form.

Another object of the present invention is the provision of such a method and apparatus utilizing a mandrel supported internally within the tube of material and operable through the material for forming an internal abutment against which the flat bag bottom may be formed.

Further objects, features and advantages of the present invention will be more fully appreciated by reference to the following detailed description of a presently preferred, but nonetheless illustrative, embodiment in accordance with the present invention when taken in conjunction with the accompanying drawings, wherein:

FIGS. 3 through 7 are sequential views of operating portions of the bag forming apparatus during the formation of a flat bottom bag thereby; and FIGS. 8 through 10 are perspective sequential views of a length of gussetted tubing as a flat bottom bag is formed therefrom.

DETAILED DESCRIPTION OF THE PREFERRED EMBODIMENT

Figure 1:
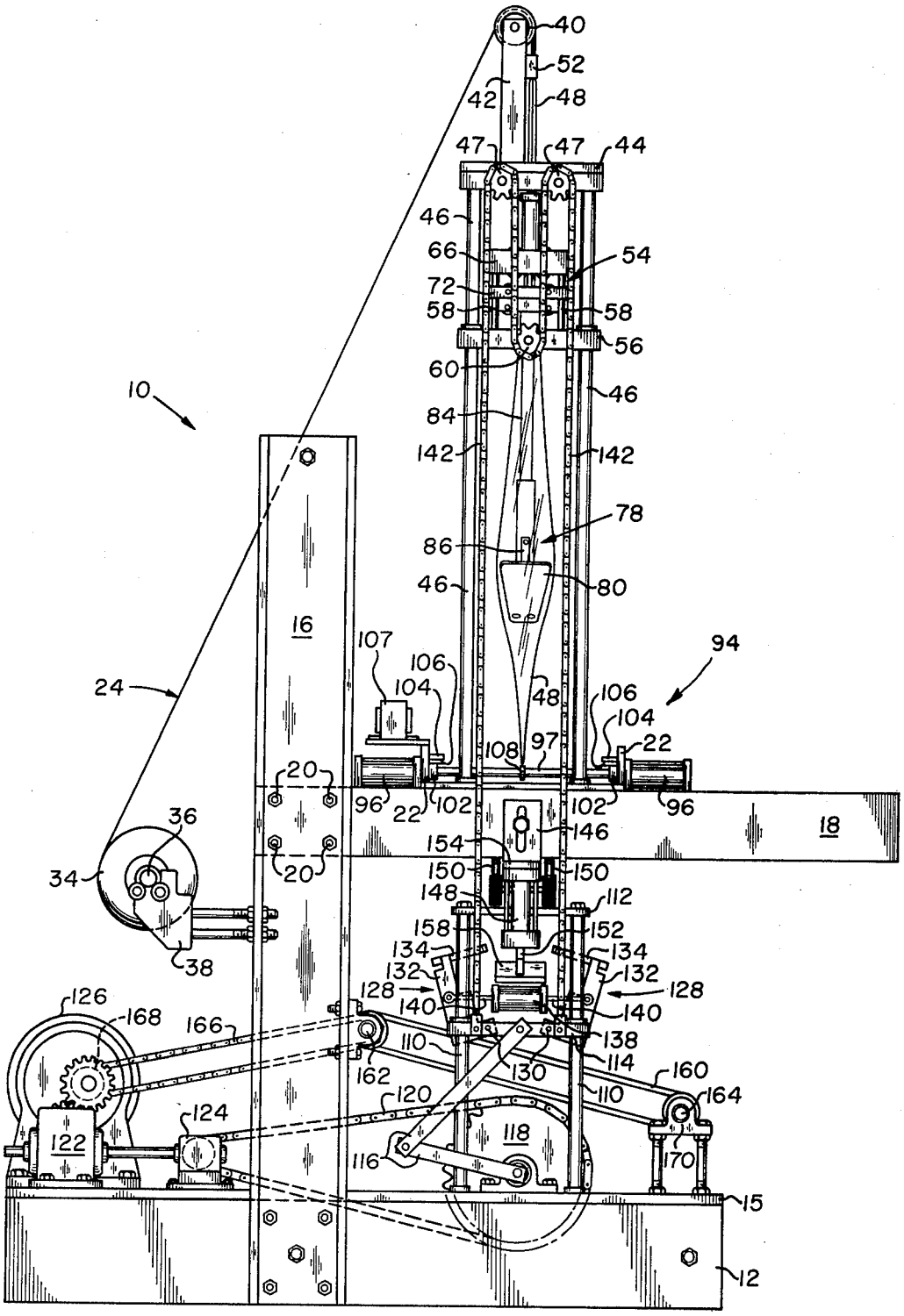
FIG. 1 is a side elevational view of a flat bottom bag forming apparatus constructed in accordance with the teachings of the present invention.
Figure 2:
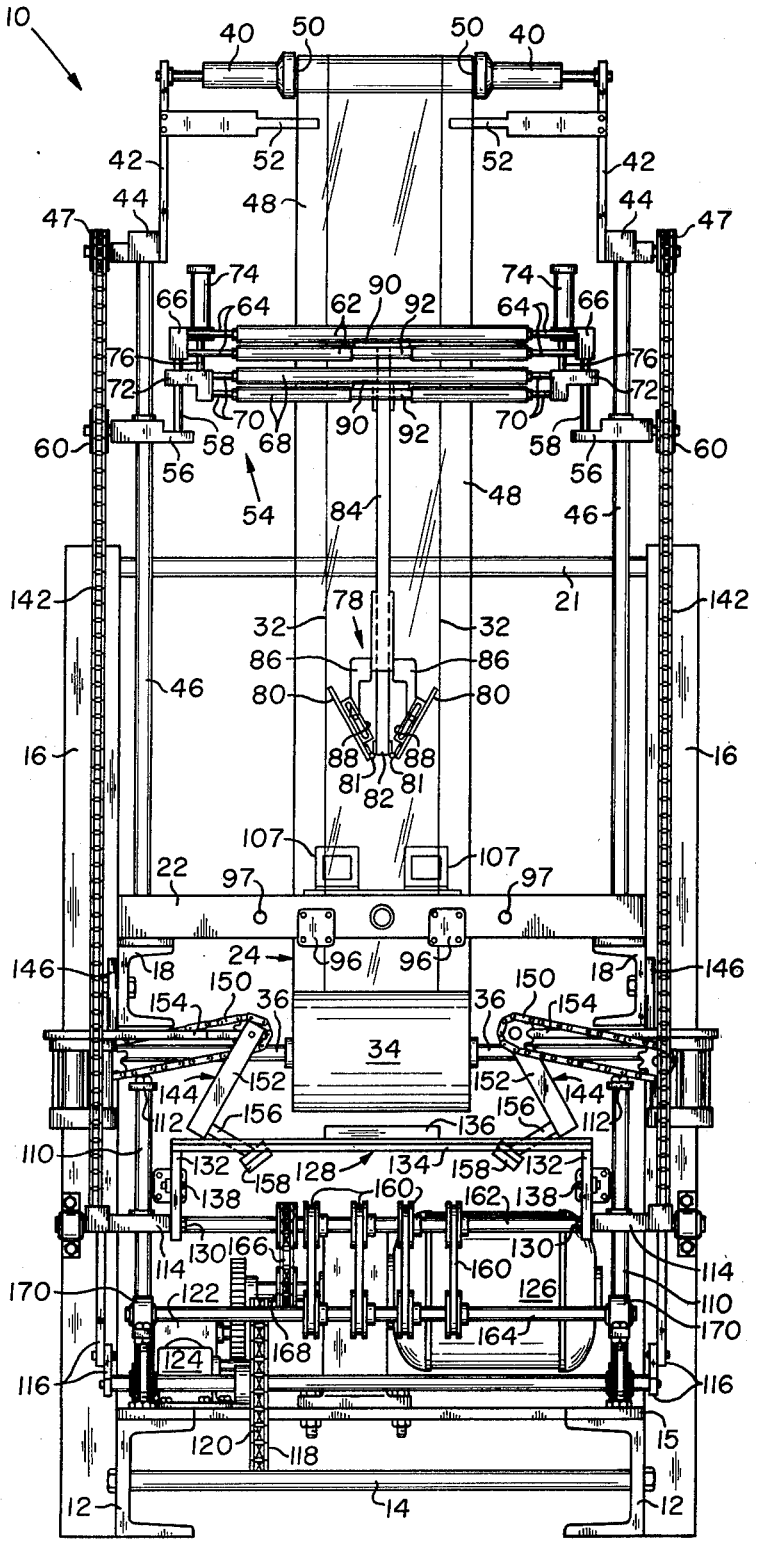
FIG. 2 is a front elevational view of the apparatus of FIG. 1.

Turning now to the drawings, there is shown in FIGS. 1 and 2 a preferred embodiment of a flat bottom bag forming apparatus constructed in accordance with the present invention and designated by the general reference numeral 10. The apparatus 10 is seen to be generally vertically disposed and, as will become clear hereinafter, the continuous formation of flat bottom bags from a supply of material is performed in the apparatus 10 along a substantially vertical operating plane. This substantially vertical orientation enables the manufacture of flat bottom bags by the forming apparatus 10 while utilizing a minimum of valuable floor space, allowing the remaining manufacturing area to be efficiently employed for printing or storage of the completed bags or in any other desired manner.

The operative components and assemblies of the apparatus 10 are mounted on a frame which serves as a support therefor and includes a pair of base members 12 connected by cross members or ties 14 spanning the same. The base members 12 may be U-shaped in cross-section as shown and are adapted to rest on a floor or like horizontal supporting surface to which the same may be bolted or otherwise secured for stabilizing the apparatus 10 against undesired movement or shifting. A base plate 15 may be provided on the base members 12 to form a surface to which structures comprising the apparatus 10 may be anchored or otherwise secured. Upstanding support columns 16 fixedly secured to the base members 12 intermediate the ends thereof extend substantially vertically therefrom and support substantially horizontal U-shaped arm supports 18 secured to the columns 16 as at the bolts 20. The spacing between the columns 16 may be maintained at the upper or free ends thereof and the overall structural strength of the frame increased by the provision of a connecting bar or tie 21 or the like connecting the vertical columns 16. A pair of horizontal connecting members 22 is further seen supported on and bridging the horizontal main arm supports 18 intermediate the ends thereof. The members 22 are so spaced apart as to position each of the same on opposed sides of a web of the bag-forming material vertically disposed on the apparatus 10 during operation thereof in a manner soon to be described.

The apparatus 10 is particularly constructed for forming flat bottom bags from a supply of relatively thin film-like material such as thermoplastic or the like. Those skilled in the art will recognize, however, that the inventive method and apparatus disclosed herein may also be applied to a wide variety of materials including plastics, paper or cloth or any combination thereof and the present invention is thus deemed to contemplate the use of various bag-forming materials.

Preferably, the thermoplastic film or material is initially in the form of a gussetted tube 24, a relatively short lengthwise portion of which is seen in FIG. 8. As thereshown, the tube or sleeve 24 comprises a pair of opposed faces 26, 28 connected by inwardly folded longitudinal side gussets 30 defining central fold or crease lines 32 of the gussets 30. The film is preferably initially in the form of a substantially endless length of the gussetted tube 24 and may conveniently be provided in a roll 34 wherein the opposed faces 26, 28 are flattened against one another with the gussets 30 inwardly folded therebetween.

A shaft 36 journalled through the supply roll 34 is rotatably supported on the apparatus 10 on brackets 38 depending from the upstanding columns 16 for substantially free and unencumbered rotation of the shaft 36 on and relative to the brackets 38. It may, however, be found to be operationally advantageous in some applications to provide a selected amount of frictional engagement between the shaft 36 and brackets 38 for the purpose of impeding free rotation of the shaft 36 so as to prevent undesired continued rotation of the supply roll 34 after withdrawal therefrom of a predetermined length of the gussetted tube 24 in a manner to be explained hereafter. The addition of such frictional means (not shown) may be accomplished in any well known manner.

From the supply roll 34, the tubular film is passed over a steering roller 40 provided at an upwardly disposed position on the apparatus 10, as for example at the topmost vertical extreme thereof as seen in FIGS. 1 and 2. The steering roller 40 is journalled between a pair of uprights 42 vertically depending from substantially horizontally disposed headers 44. The headers 44 in turn bridge and connect the free ends of adjacently positioned pairs of vertical guide standards 46 which supportedly depend from the main arm supports 18 and which are preferably of uniform cross-section substantially throughout their lengths. Put another way, each of the horizontal arm supports 18 carries a pair of substantially adjacent vertical standards 46 connected or tied together at their upper free standing ends with a header 44 in turn supporting an upright 42 vertically depending therefrom. The standards 46 carried on each of the main arm supports 18 are so positioned thereon as to dispose the same on opposite sides of a working length of the gussetted tubing 24 vertically disposed in the operating apparatus 10 as will soom become clear. A pair of toothed gears or sprocket wheels 47 is mounted for freewheeling rotation on and relative to each of the headers 44 proximate the ends thereof as will soon be understood.

The provision of the steering roller 40 at substantially the uppermost reaches of the apparatus 10 enables the roller 40 to support therefrom and within the apparatus 10 a substantially vertically disposed length 48 of the continuous gussetted tube 24. The vertically disposed film length 48 defines an axial operating plane along which the apparatus 10 operates on the gussetted material for the production of square bottom bags therefrom. The steering roller 40 may further be provided with alignment shoulders 59 for maintaining the vertically supported length 48 of gussetted material tranversely centered or otherwise properly positioned within the operating plane and relatively between the standards 46.

A pair of spreaders or gusset opening fingers 52 extend from the uprights 42 into the vertically disposed length 48 of gussetted material a distance less than the depth of the side gussets 30. The fingers 52 are positioned so that their free ends engage within the longitudinal gussets 30 of the vertically disposed material length 48 for the purpose of partially opening the gussets 30 and spreading apart the opposed face panels 26, 28. This initial partial opening of the gussetted tube or sleeve 24 facilitates the extension of the same around and about an operable mandrel structure disposed within the tube 24 and soon to be described.

A mandrel operating means generally designated 54 is relatively slidably connected with the vertical guide standards 46 for rectilinear reciprocating movement along and relative to the same. Specifically, horizontally disposed supports 56 are slidably journalled about and between adjacently positioned ones of the standards 46 and support depending guide rods 58 upstandingly thereon. A toothed gear 60 is mounted on each of the supports 56 substantially centrally between its ends and between the adjacent standards 46 guiding the support 56. The wheels 60 need not be rotatable relative to the supports 56. The gears 60, in conjunction with the header gears 47, are engageable with a driving means yet to be described to enable controlled rectilinear movement of the supports 56 and the whole of the mandrel operating means 54 along the standards 46 and to supporting retain the mandrel operating means along the same.

Still referring to FIGS. 1 and 2, two pairs of horizontally spaced and opposed upper clamping rollers individually and collectively designated 62 are journalled for free and unimpeded rotation on shafts 64 connected with the guide rods 58 at upper mounts 66. Each of the mounts 66 connects the upper free ends of the adjacently disposed guide rods 58 so that the upper rollers 62 are positionally fixed relative to the mandrel operating means supports 56. As may perhaps best be seen in FIG. 4, the upper clamping rollers 62 are so arranged as to bound a substantially rectangular configuration including a confining or clamping area between the rollers 62 when viewed from the side of the apparatus 10.

In much the same manner, two pairs of lower clamping rollers 68 are journalled for free and unimpeded rotation on shafts 70 connected between lower mounts 72. The lower mounts 72 are slidably journalled on and between adjacent ones of the guide rods 58 intermediate the ends thereof for sliding rectilinear movement reciprocally along the guide rods 58. Thus, the lower rollers 68 are rectilinearly movable toward and away from the upper rollers 62, the relative movement being accomplished by actuation of a moving means 74 fixed on each of the upper mounts 66 and connected by way of their movable pistons 76 with the lower mounts 72. Actuation of the moving means 74 results in retraction of the pistons 76 into the cylinder means 74 to cause rectilinear movement of the lower clamping rollers 68 in a direction toward the upper clamping rollers 62. Deactuation returns the upper and lower rollers 62, 68 to their normal spaced apart position. Although the moving means 74 preferably comprise pneumatic or air operated piston and cylinder actuators of conventional form, hydraulic piston and cylinder actuators or solenoid actuated pistons may also be used. Vacuum and tubular fittings and the like associated with the moving means 74 have been omitted for clarity and simplicity.

Upon leaving the steering roller 40 and the gusset opening fingers 52, the vertically disposed material length 48 passes between each of the adjacently horizontally spaced pairs of upper and lower clamping rollers 62, 68. This may be quite clearly seen in FIG. 4. Accordingly, in each of the upper and lower sets of rollers 62, 68, the horizontally opposed pairs of roller members are positioned on opposite sides of the axial operating plane defined by the vertically-disposed film 48. As will soon be understood, each of the clamping rollers 62, 68 is disposed in continuous pressing contact with the outer surface of one of the face panels 26, 28 of the gussetted tube 24, and the vertically-disposed film length 48 is axially movable through and relative to the upper and the lower clamping rollers 62, 68.

An operative mandrel generally designated 78 and substantially vertically disposed within the interior of the vertical length 48 of gussetted tubing 24 includes a pair of extensible wing-like members 80 at the downwardly-disposed end thereof. The wings 80 are movable between a retracted inoperative position seen in FIG. 6 and an extended or expanded operative position as in FIG. 5 and are shown as substantially flat trapezoidal plates. In the extended operative position, the wings or plates 80 are disposed parallel and coplanar with one another in outwardly pressing contact against at least a portion of the interior side gusset walls and portions of the face panels of the material for facilitating the formation of a flat bottom for a bag from a position within the gussetted sleeve 24. Those skilled in the art will readily recognize, however, that the substantially flat wings or plates 80 could assume any of a wide variety of shapes so long as extension of the wings 80 in the interior of the gussetted tube 24 causes the formation of side gusset flaps as will be seen hereinafter and provides sufficient surface area on the wings 80 to serve as an abutment against which sealing means yet to be disclosed operates to sealingly retain the side gusset flaps to the flattened bottom of the bag.

The wings 80 are pivotally or hingedly connected at their inner edges as at 81 to one end of an elongated mandrel supporting member or arm 82. The arm 82 is slidably journalled within an elongated actuating sleeve 84 for longitudinal movement of the arm 82 within and relative to the sleeve 84. Extensions 86 carried at one end of the actuating sleeve 84 are pinned or otherwise connected at their free ends for captured sliding retention in grooved guide members 88 on the wings 80. Thus, longitudinal reciprocating movement of the actuating sleeve 84 within and relative to the support arm 82 causes the wings 80 to move between the extended operative and retracted inoperative positions as the pinned free ends of the extensions 86 capturedly move along the grooved guide members 88.

In order to support the internal mandrel and effect relative movement between the mandrel support arm 82 and actuating sleeve 84, the arm 82 and sleeve 84 are each provided at ends thereof opposite their connection to the wings 80 with cross-sectionally arcuate head members 90. The heads 90, as best seen in FIG. 4, may have the appearance of rollers connected on opposite sides of the arm 82 and sleeve 84 and, while proper operation of the apparatus 10 does not require movement or rotation of the head members 90 relative to the arm 82 or sleeve 84, the same may be provided as freewheeling rollers within the scope of the present invention.

The heads 90 are positioned on the mandrel arm 82 and sleeve 84 for cooperative engagement in the confining or clamping areas bounded by the clamping rollers 62, 68. Specifically, the head members 90 on the mandrel supporting arm 82 are captured in the confining area bounded by the upper clamping rollers 62 and the heads 90 on the actuating sleeve 84 are confined or captured between the lower clamping rollers 68. As a consequence, the cooperative captured engagement of the head members 90 between the respective clamping rollers 62, 68 as seen in FIG. 4 serves to support the mandrel 78 substantially vertically suspended from the clamping rollers 62, 68. In addition, rectilinear movement of the lower clamping rollers 62 relative to the upper rollers 68 as a result of actuation of the moving means 74 causes corresponding relative rectilinear movement of the mandrel arm 82 and sleeve 84 which in turn effects extension of the wings 80 to their extended operative or coplanar position.

Again referring to FIG. 4, the cooperative retention or engagement of the mandrel head members 90 with the clamping rollers 62, 68 is performed through the walls of the gussetted tube 24 interposed therebetween. That is, the upper and lower clamping rollers 62, 68 confine the respective mandrel head members 90 with the face panels 26, 28 of the gussetted tube pressed between the heads 90 and the rollers 62, 68. Thus, the clamping rollers 62, 68 press inwardly against the outer surface of the sleeve of material while the cooperating head members 90 disposed within the gussetted tube press outwardly against the interior surface of the sleeve.

This cooperative engagement pressingly through the gussetted tube 24 provides the means by which the internal mandrel 78 is externally supported within the vertically disposed film and is in addition externally actuated for extension and retraction of the internally-disposed operable wings 80. While the mandrel supporting and operating means 54 functions through the pressure exerted by the clamping rollers 62, 68 on the mandrel head members 90, which pressure is sufficient to suspendedly support the mandrel 78 in place within the gussetted tube 24 and to operate the extensible wings 80, the vertically disposed film is still capable of being displaced relative to the internal mandrel 78 and external operating means 54 therefor without moving or otherwise affecting the positions of the same. The importance of this feature of the present invention will become evident as this decription proceeds.

The internal mandrel 78 is maintained within the vertically disposed length 48 of gussetted tubing 24 and on the clamping rollers 62, 68 substantially centrally positioned in a transverse direction with respect to the longitudinal axis of the vertically disposed film 48. The transverse centering is accomplished by the provision of reduced diameter central portions 92 on at least some of both the upper and lower clamping rollers 62, 68. The respective mandrel head members 90 are retained substantially centrally on the rollers 62, 68 within the defines of the narrowed portions 92. As a consequence, the mandrel is at all times retained substantially centrally between the opposed gussetted sides 30 of the vertically disposed tubular film 48 to facilitate completion of the bag bottom thereon.

A sealing and shearing assembly generally designated 94 is provided on the horizontal arm supports 18 for forming a transverse seal on the vertically disposed web of material 48 and for severing the material adjacent the transverse seal. As best seen in FIG. 3, the assembly 94 comprises actuating means or cylinders 96 or the like confrontingly disposed on opposite sides of the operating plane defined by the vertically suspended length 48 of tubular film. The cylinders 96 are secured to and supported from the connecting members 22 which are spaced apart or separated by fixed guide rods 97 bridgingly disposed therebetween. Each of the cylinders 96 includes a movable piston 98 reciprocably slidable, as indicated by the double-headed arrows 100 in FIG. 3, in response to controlled actuation of its cylinder 96. The pistons 98 are slidably journalled for movement through the connecting members 22 and carry on the outward or free ends of the pistons 98 and for reciprocating movement therewith opposed support mounts 102 which may be in the form of elongated bars of substantially rectangular cross-section.

Each of the support mounts 102 is disposed on an opposite side of the axial operating plane and supports a transverse sealing bar 104 and a cutting blade 106 which may be formed as a single integrated unit. The sealing bars 104 are heated as from a source of electric potential shown by the transformers 107 and are configured to engage opposite faces of the gussetted tube 24 for the purpose of forming a transverse heat-induced seal therealong connecting the face panels 26, 28. The cutting blades 106 are seen positioned adjacently below the sealing bars 104 for severing the gussetted material adjacent to and substantially simultaneously with formation of the transverse seal as will be described hereinafter. The sealing bars 104 and cutting blades 106 extend for at least the width of the face panels 26, 28 of the gussetted material tube 24 to enable the film to be sealed and severed transversely across its full width.

The support mounts 102 may be provided with bushings ridable on the rods 97 for guiding the support mounts 102 through simultaneous reciprocating movement toward and away from each other so as to effect cooperative engagement of the confrontingly opposed sealing bars 104 and cutting blades 106. To prevent the mutual abutment of the cutting blades 106 which could damage the same and to insure that the abutment of the opposed sealing bars 104 as well as the cutting or severing of the film takes place substantially in the axial operating plane wherein the gussetted tubing 24 is disposed, a bumper 108 as of rubber may be provided on each of the guide bars 97 substantially centrally positioned along their lengths and between the members 22. In this manner, each of the support mounts 102 carrying a sealing bar 104 and cutting blade 106 is prevented from being moved through and beyond the axial operating plane wherein is positioned the vertically disposed length 48 of gussetted material. As a result, transverse sealing and severing of the gussetted tube 24 is performed substantially coaxially with and in the operating plane, thereby minimizing undesired movement of the vertically disposed or suspended length of film 48 out of or beyond the operating plane defined thereby as the sealing and severing operation is carried out.

Upwardly depending from the base members 12, in substantial one-to-one alignment with the guide standards 46 supported from the arm supports 18, are lower vertical standards 110 preferably of generally uniform cross-section throughout their lengths. Each base member 12 supports an adjacently positioned pair of the lower standards 110 and, as may be clearly seen in FIG. 1, the standards 110 terminate at their upwardly disposed freestanding ends short of the main arm supports 18 and each pair are connected or tied at their free ends with a spanning member 112.

A bridging member 114 is loosely journalled between the lower standards 110 of each adjacently positioned pair thereof for guided vertical reciprocating movement along the standards 110. A pair of pivot cranks 116 operatively connect the bridging members 114 with a sprocketed gear 118 rotatively supported for driving the pivot cranks 116 to cause the members 114 to reciprocate vertially along the standards 110. Rotation of the driving gear 118 is effected by a sprocket-engaging chain 120 or the like driven through a gear box 112 and reduction gear unit 124 by a drive motor 126. As the gear 118 is turned, it causes alternating extension and retraction of the pivot cranks 116 to respectively raise and lower the bridging members 114 along the guide standards 110.

Connected between the bridging members 114 are a pair of opposed grippers generally designated 128, one of which is disposed on either side of the axial operating plane defined by the vertically-disposed film length 48. The grippers 128 are pivotally connected or pinned at 130 to the bridging members 114 and include extensions 132 carrying depending gripping bars 134. The elongated bars 134 may extend for at least the width of the face panels 26, 28 of the gussetted tube 24 as shown and include gripping pads 136 inwardly projecting toward the axial operating plane intermediate the ends of the bars 134 and preferably of a length less than the width of the face panels 26, 28 as will be understood hereinafter.

A pair of double-ended movers or actuating cylinders 138 which may be of the pneumatically-operated type are disposed connectingly between the opposed grippers 128 for pivotally moving the same toward and away from one another to respectively grip and release a portion of the vertically-disposed film. More specifically, piston rods 140 on each cylinder 138 are connected at their free ends to a central portion of the oppositely or facingly disposed gripper extensions 132. Simultaneously actuation of the cylinders 138 to cause retraction of the pistons 140 effects pivotted movement of the opposed grippers 128 into mutual abutted engagement at the gripping pads 136 and substantially within the axial operating plane. The grippers 128 are, in addition, carried through vertical reciprocating movement along the lower standards 110 as the bridging members 114 are driven by the pivot cranks 116 through corresponding guided movement along the standards 110.

Each of a pair of a chain-link drives 142 is fixedly connected at one of its ends to one of the bridging members 114. As best seen in FIG. 1, each chain 142 extends upwardly from the member 114, respectively over and under the toothed gears 47 and 60 disposed proximate the upper portion of the apparatus 10, and is connected or secured at its other end to the same bridging member 114. Thus, inasmuch as the gears 47 are carried on the fixed headers 44 and the gears 60 on the vertically movable mandrel operating means supports 56, the chain 142 serves to vertically suspend and support the mandrel operating means 54 at a position along the length of the guide standards 46.

The particular suspended position of the mandrel operating means 54 on the standards 46 is a function of both the length of the chains 142 and of the position of the gripper-carrying bridging members 114 along the lower vertical standards 110. The position of the bridging members 114—and of the grippers 128—along the lower standards 110 is in turn determined by the amount of extension of the pivot cranks 116.

Accordingly, those skilled in the art will readily recognize that the effect of raising the bridging members 114 guidedly along the lower standards 110 in response to operation of the pivot cranks 116 is the lowering of the horizontal supports 56 along the upper standards 46 and relative to the vertically fixed headers 44, and vice versa. The mandrel operating means 54 is, as a consequence of being carried on the slidable supports 56, vertically movable therewith along the standards 46. In addition, the operating means 54 carries the internally disposed mandrel 78 suspended therefrom and through corresponding vertical reciprocating movement. Thus, driven vertical rectilinear movement of the grippers 128 along the lower standards 110 causes oppositely-directed vertical rectilinear movement of the mandrel operating means 54 along the upper standards 46 and of the internal mandrel 78 axially within the vertically-disposed length 48 of gussetted film or material. Put another way, raising the grippers 128 lowers the mandrel 78, and lowering the grippers raises the mandrel.

A flap sealing means is provided on the apparatus 10 for sealably retaining the flat bag bottom formed on the vertically-disposed gussetted tube. The sealing means comprises a pair of pivotally mounted flap sealing arms or assemblies generally designated 144, each of which is vertically adjustably supported along the axial operating plane from one of the horizontal arm supports 18 at a grooved retaining plate 146. The sealing arms 144 are each pivotally movable from an inactive to an active or sealing position in response to actuation of pneumatic cylinders 148 or the like operably connected with the sealing arms 144 by way of motion transmitting or drive chains 150.

More particularly, each flap sealing arm 144 includes an elongated lever arm 152 pivotally connected an an end along the length thereof to a horizontal support extension 154 inwardly depending into the apparatus 10 from one of the vertically adjustably supported retaining plates 146. The lever arm 152 carries on its end opposite the pivotal connection a seal-supporting extension 156 including a flap sealing head 158 which may be electrically heated by means of the transformers 107 for the purpose of forming a heat-induced seal on the thermoplastic gussetted tube 24. Preferably, the length of the sealing heads 158 substantially corresponds to the width of the material side gussets 30 when the same are expanded or opened during formation of flat bottom bags in the apparatus 10.

A plurality of carry-off conveyors or belts 160 are adjacently disposed along the axial operating plane and connected between a driven shaft 162 and an idler shaft 164. The driven shaft 162 is bearingly mounted for rotation on and between the main support columns 16 and is connected through a chain 166 with a sprocket wheel 168 driven by the motor 126 for causing the shaft 162 to rotate at a predetermined rate. As seen in FIG. 1, the idler shaft 164 is freewheelingly journalled in bushings 170 supported from the base plate 15 on the side of the axial operating plane opposite the shaft 162 and somewhat below the relative height thereof. Thus, the disposition of the conveyors or belts 160 is such as to cause objects placed or otherwise deposited thereon to be moved along the belts 160 to the front or right side of the apparatus 10 as seen in FIG. 1.

Operation of the apparatus 10 is initiated by placing a roll 34 of the gussetted tubular film or material 24 on the freely rotatable shaft 36. The leading edge of the film is extended upwardly over the steering roller 40 and between the gusset spreaders 52 so that the free ends of the fingers 52 extend into the side gussets 30 between the opposed face panels 26, 28 to partially open the gussets and space apart the opposed faces of the sleeve. The leading edge of the film is further extended downwardly from the spreaders 52 and between the opposed pairs of upper and lower clamping rollers 62, 68 so as to interpose the gussetted tube or sleeve between the clamping rollers and the mandrel head members 90 which support the mandrel 78 within the interior of the tubular film. The leading edge of the material is further extended enclosingly about the mandrel and along the substantially vertically-disposed elongation thereof to advance the leading edge of the gussetted tube 24 to a position below the mandrel 78 and at least adjacent the sealing and shearing assembly 94.

At the initiation of the steps and operations performed by the apparatus 10 for forming flat bottom bags, the relative rotative position of the drive gear 118 is such as to fully retract the pivot cranks 116 and consequently support the grippers 128 at their lowermost or minimum height-wise position along the lower guide standards 110. Accordingly, and by way of the linking chain drives 142, the mandrel 78 is initially suspended from its operating and support means 54 at its uppermost point or maximum height-wise position along and relative to the vertical guide standards 46 and within the vertically-disposed length 48 of gussetted tubing 24. The operable wings 80 of the mandrel 78 are initially in the collapsed or retracted position at the commencement of the bag forming sequence.

In the first stage of operation, the cylinders 96 are simultaneously actuated to operate the sealing and shearing assembly 94. As seen in FIG. 3 and therein denoted by the arrows 100, actuation of the cylinders 96 causes the opposed pairs of sealing bars 104 and cutting blades 106 to move inwardly toward each other. The sealing bars 104 abut and engage the opposed faces 26, 28 of the vertically-disposed length of film 48 to form a transverse heat-induced seal generally designated 172 across the length of the gussetted tube 24. The sealing bars 104 are then retracted outwardly or away from the axial operating plane of the film or material. Almost simultaneously with the formation of the transverse seal 172, the opposed cutting blades 106 transversely sever the face panels 26, 28 of the film adjacently below the transverse seal 172 so as to form a skirt 174 on the gussetted film beyond the transverse seal. Typically the width of the skirt 174 may be approximately one-quarter to one-half inch.

FIG. 9 shows a portion of the vertically-disposed film 48 including the transverse seal 172. The seal 172 may be seen to connect the opposed face panels 26, 28 along the transverse seal line and to include therein a portion of the gussetted sides 30 in the area of the transverse seal 172. Thus, the downwardly disposed ends of the gusset folds 32 are sealingly captured in the transverse seal 172 which forms an end or bottom closure for the vertically-disposed length of film 48.

Following operation of the sealing and shearing assembly 94, the drive gear 118 is rotated to operate the pivot cranks 116. As the pivot cranks 116 are extended to raise the grippers 128, the linking chain drives 142 cause the mandrel operating and support means 54 to be correspondingly lowered along the guide standards 46. As a consequence, the mandrel 78 suspended from the operating means 54 is caused to move downwardly within and relative to the vertical film. This upward movement of the grippers 128 and corresponding linked downward movement of the mandrel 78 continues until the pivot cranks 116 reach their fully extended position.

As the mandrel 78 is caused to move from its maximum to its minimum height-wise position relative to the vertical standards 46, edges of the retracted wings 80 abut the interior of the transverse end closure seal 172 at an early point in the downward travel of the mandrel. As earlier described, the gussetted film is disposed for relative longitudinal movement intermediate and between the clamping rollers 62, 68 and the mandrel head members 90 which cooperate with the rollers through the film. Thus, the internal abutment of the retracted mandrel wings 80 with the transverse end closure seal 172 and the continued downward movement of the mandrel 78 causes the vertically disposed length of film 48 to be longitudinally advanced along the vertical operating plane of the apparatus 10 together with and by the mandrel 78.

At the termination of the concurrent downward movement of the mandrel 78 and upward movement of the grippers 128, the mandrel 78 and grippers 128 have been moved vertically along the apparatus 10 into positions of substantial adjacency as seen in FIG. 4. Actuation at this point of the operating cylinders 138 causes the grippers 128 to pivot inwardly about the hinged connections 130 so as to engage the material skirt 174 between the opposed gripping pads 136. Substantially simultaneously therewith the cylinders 74 are actuated to move the lower clamping rollers 68 relatively away from the upper clamping rollers 62 to increase the spacing or separation of the same and thereby cause the extension of the mandrel wings 80 within the vertically-disposed gussetted sleeve 48.

Extension of the mandrel wings 80 into their expanded operative position as seen in FIG. 5 causes the wings to press against the transverse seal 172 and the interior surfaces of the sleeve of material adjacent the transverse seal. The wings 80 flatten in their expanded position against the interior surfaces of the side gussets 30 sealed at the transverse end closure seal 172 to flatten the gussets against the transverse seal. As shown in FIG. 10, the result is the formation of flaps 176 of the side gussets 30 and the opening of the gusset sides of the material to space apart the opposed faces 26, 28 and form a flat bottom 178 for a bag including the transverse seal 172. The side gussets flattened in the area of the transverse seal 172 may be seen to form creases or folds 180 along the side edges of the flat bag bottom 178 and between the opposed faces 26, 28 of the sleeve. The gusset flaps 176 are positioned interior of the flat bottom 178 thus formed in interposed relation between the extended mandrel wings and the flat bottom including the transverse seal 172.

In order to retain the flat bag bottom 178 so formed, the sealing arms 144 are pivoted inwardly to their active or sealing position seen in FIG. 5 and engagingly against the external surface of the flat bottom 178 formed by the extended mandrel wings 80 to flatten and seal together the flat bottom and preselected portions of the side gusset flaps 176. It will be recognized that the extended mandrel wings 80 form an interior abutment within the material sleeve against which portions of the opposed faces 26, 28 forming the flattened bag bottom 178 are pressed by the flap sealing arms 144. The heated sealing heads 158 press together the flat bottom 178 and the preselected portions of the side gusset flaps 176 to seal the same together while utilizing the extended mandrel wings 80 as a backing or abutment therefor. The flat bottom 178 thus formed is consequently of double-sealed or reinforced construction by reason of the provision and sealing of the side gusset flaps 176 along portions of the flat bottom which includes the transverse seal 172.

It should be noted that the particular sequence of operations depicted in FIGS. 3 through 5 and described hereinabove has been set forth merely for purposes of clarity and simplicity of description and is not meant to be construed as necessary or essential to proper operation of the bag forming apparatus 10. In fact, many of the operations actually occur substantially simultaneously with one another and it is, therefore, within the scope of the present invention that certain ones of the steps could take place either earlier or later than others of the steps. Thus, by way of example, actuation of the cylinders 74 to cause the operation extension of the mandrel wings 80 could take place before or simultaneously with the commencement of downward movement of the mandrel 78 or during the course of such movement. As a consequence, these and other variations in the sequence of operations are deemed to be included within the contemplation of the present invention and the particular order of events herein described is not meant to constitute a limitation thereon.

Following the heat-induced sealing of the flat bottom 178 to preselected portions of the side gusset flaps 176, the flap sealing arms 144 are pivotally retracted as in FIG. 6 to their inactive position remote from the flat bottom 178. The mandrel wings 80 are moved substantially concurrently therewith to their inoperative position spaced from the interior surfaces of the gussetted tube by relative movement of the lower clamping rollers 68 upwardly toward the upper clamping rollers 62. At this point, the grippers 128 remain in opposed captured engagement of the material skirt 174 and as a consequence the vertically disposed sleeve length 48 is held in position during retraction of the mandrel wings 80 and the flap sealing arms 144.

The drive gear 118 is thereafter rotated so as to retract the pivot cranks 116 and carry the grppers 128 downwardly along the lower guide standards 110. Inasmuch as the grippers 128 remain in clamped engagement about the material skirt 174, such movement of the grippers causes the further advancement or downwardly directed movement of the vertical length of film 48 and of the flat bag bottom 178 formed thereon. The mandrel 78 is correspondingly concurrently raised within and relative to the advancing film and along the guide standards 46. This may be seen in FIG. 7.

When the pivot cranks have been fully retracted so as to position the grippers 128 at the nadir of their vertical rectilinear movement, the sealing and shearing assembly 94 is again operated by way of actuation of the cylinders 96 and the grippers 128 are pivoted away from the material skirt 174 so as to release the clamped engagement of the same. The cutting blades 106 are moved against the opposed face panels 26, 28 to separate the flat bottom bag formed on the vertically-disposed length of film 48 from the remainder of the gussetted sleeve of material and to provide an opening at the end of the bag opposite the flat bottom 178. At the same time, opposed relative movement of the heat sealing bars 104 causes the formation of a new transverse seal on the vertically-disposed film for closing the end of the remaining length thereof to enable another flat bottom bag to be formed thereon.

The completed flat bottom bag which has been severed or detached from the web of gussetted tubing 24 is accordingly permitted to drop downwardly onto the carry-off conveyors 160. The belts or conveyors 160 carry the completed bag away from the substantially vertical operating plane and operating assemblies of the apparatus 10 for filling or folding or storage of the completed bags as desired.

It can, therefore, be appreciated that the present invention provides a relatively simple method and apparatus for the rapid and continuous formation of reinforced flat bottom bags. The apparatus 10 disclosed herein is particularly suited for the formation of flat bottom bags from a substantially endless roll or supply of relatively thin, gussetted plastic tubing. Moreover, the disclosed embodiment of the present invention is relatively simple in construction and operation to facilitate the forming of flat bottom bags along a substantially vertical operating plane in a rapid and continuous manner and at relatively low cost.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In an apparatus for forming flat bottom bags from a continuous sleeve of material having opposed faces and sides, a mandrel adapted for floating and being enclosed within the sleeve of material for rectilinear movement therewithin, said mandrel having relatively movable actuating members, wings means on said mandrel connected with said actuating members for movement thereby between an expanded operative position and a retracted inoperative position, said wings means in said expanded operative position pressing against the interior surfaces of the sleeve of material to open the sides of the same and flattening a portion of the faces of the material to form a flat bottom of a bag and being disposed in said retracted inoperative position substantially remote from the interior surfaces of the sleeve to permit movement of the sleeve of material beyond and relative to said mandrel, means external of the sleeve of material engaging opposed faces thereof and for actuating said actuating members, cooperative means on said mandrel actuating members in operative engagement with said external means for actuation thereby, and means connected with said external means to move at least part of the same rectilinearly to cause said actuating members to move correspondingly rectilinearly to cause said wings means to move between their extended operative and retracted inoperative positions.

2. In an apparatus according to claim 1, said external means comprising a plurality of sets of rollers, and said cooperative means comprising means for engaging said rollers in pressing contact therewith through the sleeve of material to enable the sleeve to move between said rollers and said mandrel cooperative engaging means without restriction.

3. In an apparatus according to claim 2, said mandrel being disposed substantially vertically within the sleeve of material in cooperative suspension from said external means.

4. In an apparatus according to claim 3, said cooperative means comprising roller means on said mandrel actuating members cooperatively captured between adjacently disposed sets of said external rollers for supporting said mandrel in said substantially vertical suspended position and for captured rectilinear movement of at least part of said mandrel roller means in response to rectilinear movement of at least part of said external means to cause said corresponding relative movement of said actuating members.

5. In a vertically disposed apparatus for forming flat bottom bags from a continuous sleeve of material having opposed faces and sides gussetted inwardly between the opposed faces, means for supporting a length of the sleeve of material substantially vertically on said apparatus, an elongated mandrel substantially vertically disposed within the material sleeve and having relatively movable actuating and support members and operable wings connected with said members for moving said wings between extended and retracted positions in response to relative movement of said actuating and support members, first and second relatively movable roller means on said apparatus disposed externally of the opposed faces of the sleeve of material and operatively engageable with said mandrel for moving said wings between said expanded and retracted positions, cooperating means on said actuating and support members opposite said wings for engagement with said first and second roller means and for relatively moving said actuating and support members in response to relative movement of said first and second roller means to cause the operation of said wings, said first and second roller means being positioned in contact with the outer surface of the opposed material faces and engaging said mandrel cooperating means in pressing contact through the material to suspend the mandrel within the material sleeve from said first and second roller means while enabling unrestricted axial movement of the material sleeve between and relative to said roller means and cooperating means.

6. In an apparatus according to claim 5, said first and second roller means including alignment means thereon for maintaining said internally disposed mandrel substantially centrally disposed between the gussetted sides of the material sleeve.

7. In an apparatus according to claim 5, a substantially vertically disposed frame supporting said first and second roller means and said material vertical support means, and spreader means on said frame and projecting into the path of the vertically disposed length of material for partially opening the gussetted sides of the sleeve of material.

8. In an apparatus according to claim 5, means on said apparatus for forming a transverse seal on the substantially vertically disposed length of material sealing together the opposed faces thereof and including a portion of the gussetted sides of the sleeve to close an end of the sleeve such that movement of said mandrel wings to said extended position causes said wings to flatten against the interior surfaces of said end closure seal and of the side gussets sealed thereat to form on the sleeve of material a flat bottom for a bag and flaps of the side gussets, and means on said apparatus for severing the material adjacent and along said transverse seal to form a skirt on the material beyond said seal.

9. In an apparatus according to claim 8, said roller means being movable along and relative to said apparatus, and means on said apparatus operable for gripping said skirt and movable along said apparatus for moving the substantially vertically disposed length of material along said apparatus and relative to said mandrel.

10. In an apparatus according to claim 9, drive means cooperatively connected with said roller means and with said gripping means to cause simultaneous movement of said roller and gripping means along said apparatus in opposite directions relative to each other for moving said gripping means in a direction along said apparatus to advance the substantially vertically disposed sleeve length correspondingly therealong while concurrently moving said roller means in an opposite direction along said apparatus to move said internally disposed mandrel in said opposite direction and relative to the advancing length of material.

11. In an apparatus according to claim 8, flap sealing means on said apparatus movable into engagement against the external surface of the flat bottom of the bag formed by said extended wings to flatten and seal the side gusset flaps against the flat bottom to sealingly retain the flat bottom of the bag and the side gusset flaps together.

12. In an apparatus for forming a flat bottom bag from a substantially endless sleeve of material having opposed faces and gussetted sides connecting the same, transverse seal forming means for completing a transverse seal on the sleeve of material connecting the opposed faces and including the gussetted sides in the area of the transverse seal, a mandrel including interior means movable interior of the sleeve of material for opening the gussetted sides and opposed faces thereof to form a flat bottom for a bag in the area of and including said transverse seal, said mandrel further including actuating means for operating said interior means said interior means being movable from an inactive to an active position to flatten the open gussetted sides in the area of said transverse seal to crease the same between the opposed faces of the sleeve so that the gussetted sides form interior flaps for sealing to said flat bottom, and means on said apparatus exterior of the sleeve of material and engaging said actuating means through the faces of the sleeve interposed therebetween for moving the interior movable means between its inactive and active positions within and relative to the sleeve.

13. In an apparatus according to claim 12, said interior means including operable wings movable between an extended operable position flattening the same against said open side gussets to form said creases and against at least a portion of said flat bottom and a retracted inoperable position spacing said wings inwardly of the interior surface of the sleeve of material for movement of the sleeve relative to said interior means.

14. In an apparatus according to claim 13, relatively movable actuating members on said interior means cooperatively engaging said exterior means through the sleeve of material and connected with said wings for effecting movement of said wings between said extended operative and retracted inoperative positions.

15. In an apparatus according to claim 14, said exterior means being operable to cause said actuating members to move relative to each other to operate said wings.

16. In an apparatus according to claim 15, said exterior means cooperatively engaging said actuating members through the sleeve of material to suspend said interior means substantially vertically from said exterior means.

17. In an apparatus according to claim 16, said exterior means comprising a plurality of roller pairs for said cooperative engagement with said actuating members through the sleeve of material, some of said roller pairs being movable relative to others of said roller pairs for causing relative movement of said actuating members.

18. In an apparatus according to claim 17, said actuating members including rollers thereon and interior of the sleeve of material for cooperative engagement through the sleeve between ones of said exterior plural roller pairs for suspending said interior means substantially vertically from said exterior means and for causing relative movement of said actuating members in response to operation of said exterior means for moving said wings between said extended operative and retracted inoperative positions.

19. In an apparatus according to claim 12, gusset seal means engageable with the flat bottom for pressing the same against the interior flaps such that said interior means forms an abutment for said gusset seal means to seal preselected portions of the interior flaps to the flat bottom to form a double thick bag bottom.

20. In an apparatus according to claim 19, said gusset seal means being movable from an inactive retracted position to an active gusset sealing position.

21. In an apparatus according to claim 19, means on said apparatus to transversely sever the sleeve of material adjacent a next adjacent transverse seal on the sleeve to define an opening of a flat bottom bag formed from the sleeve and closed by said flat bottom at an end of the bag oppositely disposed from said opening.

22. In an apparatus for forming a flat bottom bag having a double seal from a sleeve of material having opposed faces and gussetted sides, means for engaging the opposed faces of the sleeve to form thereon a transverse seal and to include in said transverse seal the gussetted sides interior means including wing-like means movable and operable within the sleeve to open the gussetted sides and to press the same against the transverse seal and interior portions of the opposed faces while opening the sleeve to flatten the same and the gussetted sides in the area of the transverse seal, said interior means further including relatively movable actuating means for operating said wing-like means, seal means engaging an area of the sleeve at which the gussetted sides are flattened and pressing against the outer surface of the opposed faces with said interior means forming an abutment against which the opposed faces are pressed, said seal means sealing the opposed faces and gussetted sides pressed against each other to seal the same together to form a double thick bag bottom, and cooperating means on said apparatus adjacent the outer surface of the sleeve and engageable with said interior means through the sleeve of material for supporting said interior means within the sleeve and for operating said members for forming said interior abutment while permitting lengthwise movement of the sleeve between and relative to said cooperating means and said interior means.

23. In an apparatus according to claim 22, said interior means including a pair of wings movable between an extended operative position defining said abutment for pressed engagement with said seal means and a retracted inoperative position wherein said wings are disposed out of pressed engagement with said seal means.

24. In an apparatus according to claim 23, said interior means including relatively movable members connected with said wings for moving the same between said extended operative and said retracted inoperative positions.

25. In an apparatus for forming a reinforced flat bottom bag from a sleeve of material having opposed faces and gussetted sides therebetween, transverse seal means for connecting the opposed faces of the sleeve along a transverse portion thereof and including in said seal the gussetted sides adjacent thereto, means interior of the sleeve of material operable for opening the sleeve to expand the side gussets and relatively space apart the opposed faces to form a flat bottom for a bag in the area of and including said transverse seal and cause the formation of side gusset flaps, said means interior of the sleeve further including actuating means means exterior of the sleeve engaging said actuating means through the faces of the sleeve interposed therebetween for operating said means interior of the sleeve, and gusset sealing means on said apparatus pivotally movable with the operation of said interior means between an inactive position remote from the sleeve of material and an active position in which said gusset sealing means is pivotted inwardly with respect to said interior means for engaging the outer surface of said flat bottom and pressing the same against said side gusset flaps such that said interior means defines an abutment interior of the sleeve for sealing said flat bottom to preselected portions of said side gusset flaps to form a reinforced bag bottom on the sleeve of material.

26. In an apparatus according to claim 25, means exterior of the sleeve of material for cooperative engagement with said interior means through the sleeve to enable longitudinal movement of the sleeve between and relative to said cooperatively engaged interior and exterior means, said exterior means being rectilinearly movable on said apparatus for causing corresponding rectilinear movement of said interior means within and relative to the sleeve of material.

27. In an apparatus according to claim 26, means on said apparatus for causing longitudinal movement of the sleeve of material along said apparatus and between and relative to said cooperatively engaged exterior and interior means, and linking means connecting said exterior means and said sleeve moving means for effecting simultaneous opposed rectilinear movement of said exterior and sleeve moving means in timed sequence with the operation of said interior means.

28. In an apparatus for forming flat bottom bags from a substantially endless web of gussetted tubular material having opposed substantially flat faces and longitudinally gussetted sides, a mandrel disposed within the tubular material having relatively movable actuating members and extensible wings movable from retracted inoperative to expanded operative positions to cause the tubular material to open at its gussetted sides with the opposed faces of the material remaining substantially flat, said actuating members each being engaged with said wings to move the wings between their operative and inoperative positions in response to the relative movement of said actuating members, operating means external of the tubular material and in operative cooperation with said actuating members through the material, said operating means being operable to cause said actuating members to move relative to each other, means on said apparatus for forming a transverse end closure seal on the tubular material to include within the seal the gussetted sides of the material, means to sever the material adjacent the transverse seal to form a skirt on the material beyond said transverse seal, gripping means on said apparatus operable for gripping said skirt on the material and to move the material along said apparatus and relative to said mandrel, said wings flattening in said expanded position against the interior surfaces of the side gussets sealed at said transverse end closure seal to flatten the same against said transverse end closure seal to form flaps of the gussets and to open the gussetted sides of the material to form a flat bottom for a bag, and flap sealing means on said apparatus movable to and from an active position in sealing engagement with the external surface of the flat bottom of the bag to seal the flat bottom engaged by said flap sealing means with preselected portions of the flaps formed by said wings.

29. In an apparatus according to claim 28, means on said operating means for maintaining the mandrel aligned within the tubular web of material substantially centrally between the gussetted sides of the material.

30. In an apparatus according to claim 28, spreader means engaging the gussetted sides of the tubular material for at least partially opening the gussetted sides in advance of said internally disposed mandrel to facilitate movement of the tubular material around and relative to said mandrel.

31. In an apparatus according to claim 28, said operating means cooperating with said mandrel actuating members through the tubular material to therein support said internally disposed mandrel, and means connecting said operating means and said gripping means and operable to cause simultaneous rectilinear movement of said operating and gripping means along said apparatus in opposite directions relative to each other to advance the tubular material along said apparatus while concurrently moving said internally disposed mandrel in an opposite direction relative to the advancing tubular material.

32. In an apparatus according to claim 28, said operating means comprising plural pairs of rollers engaging the outer surfaces of the opposed faces of the tubular material and operatively cooperating with said mandrel actuating members through the opposed faces interposed between said operating means and actuating members, some of said pairs of rollers being rectilinearly movable relative to others of said pairs of rollers for operating said operating means to cause said actuating members to move relative to each other.

33. In an apparatus according to claim 28, means for supporting a vertically disposed length of the sleeve of tubular material substantially vertically in said apparatus, said mandrel being substantially vertically disposed within said vertically disposed length of the tubular material.

34. In an apparatus according to claim 28, said flap sealing means comprising at least an arm pivotally movable from an inactive position to said active position in which said flap sealing means is pivotted inwardly with respect to the flat bottom formed by extension of said mandrel wings for sealing the flat bottom to said flaps so as to position said flap sealing means in said inactive position remote from the tubular material and from the flat bottom formed thereon for facilitating unrestricted movement of the tubular material along said apparatus.

35. A method of making a reinforced flat bottom plastic bag comprising the steps of:

providing a sleeve having opposed faces and sides gussetted inwardly between the opposed faces, closing one end of the sleeve with a seam to seal the opposed faces together with the gussetted sides therebetween, providing a means exterior of the sleeve and wing-like means interior of the sleeve, opening the gussetted sides by operating said wing-like means by said means exterior of the sleeve through the faces of the sleeve interposed therebetween such that said wing-like means flatten the gussetted sides against the opposed faces to form flaps of the gussetted sides that have folds lying in overlapping relationship with the opposed faces while moving together the sleeve and said wing-like means included within the sleeve, and securing together preselected portions of the flaps and the overlapping sides and faces to form a flat bottom by pressing preselected portions of the flaps and the overlying sides and faces together at the preselected portions and heat sealing to secure the same together thereat.

36. The method of making a reinforced bag according to claim 35 including the step of gripping the sleeve adjacent the seam to move the sleeve relative to and free of the means included therewithin.

37. The method according to claim 35 including the step of operating the means within the sleeve to cause it to open the gussetted sides and flatten the same against the opposed faces and to retract an operating portion of the means within the sleeve after the overlapping sides and faces and the preselected portions of the flaps are secured together.

38. The method according to claim 37 including the step of operating the means within the sleeve from outside the sleeve and through the opposed faces of the sleeve without affecting the movement of the sleeve.

39. The method according to claim 35 including the step of cutting the sleeve from an endless tube of material to form the opening of a bag and forming a seam adjacent the cut for closing the cut end of the endless tube of material to form the closed bottom of a bag.

40. A method of forming a flat bottom reinforced plastic bag from a continuous sleeve of material having opposed faces and gussetted sides, transversely sealing the sleeve to hold the gussets in place between the opposed faces in the transverse seal and to define a closed bottom of the bag, providing a means exterior of the sleeve and a bag opening means interior of the sleeve, moving the sleeve of material along with said bag opening means enclosed within it while operating the bag opening means within the sleeve by said means exterior of the sleeve through the faces of the sleeve to cause the bag opening means to open the bottom of the bag to form flaps of the side gussets, moving a flat heat seal into and out of engagement with the exterior surfaces of the sleeve while pressing the side gusset flaps against the interior of the opposed faces to cause the flaps and the faces to be heat sealed together at preselected portions thereof, and moving the bag sleeve off of the enclosed means after moving the flap seal out of engagement with the sleeve.

41. The method according to claim 40 including the step of moving the sleeve in a substantially vertical plane for forming the reinforced flat bottom bag therefrom along said plane.

42. The method according to claim 40 wherein said step of opening the bottom of the bag by operating the enclosed means includes pressing against the interior surfaces of the side gussets held at the transverse seal to flatten the same against the transverse seal to form the side gusset flaps and to open the gussetted sides of the sleeve to form a flat bottom for a bag.

43. The method according to claim 40, engaging and operating the enclosed means through the faces of the sleeve to open the bottom of the bag.

44. The method according to claim 40, including the step of transversely severing the sleeve to form an opening of the bag at an an end of the sleeve opposite the closed bottom.

* * * * *